United States Patent [19]

Siegel

[11] Patent Number: 4,736,599

[45] Date of Patent: Apr. 12, 1988

[54] SELF COOLING AND SELF HEATING DISPOSABLE BEVERAGE CANS

[76] Inventor: Israel Siegel, 2980 Point East Dr., Apt. D-612, North Miami Beach, Fla. 33160

[21] Appl. No.: 941,999

[22] Filed: Dec. 12, 1986

[51] Int. Cl.[4] ..... B67D 5/62

[52] U.S. Cl. ..... 62/294; 62/4; 62/457; 62/480; 62/530; 126/263

[58] Field of Search ..... 62/4, 293, 294, 330, 62/530, 457, 480, 371; 126/263; 165/61, 2

[56] References Cited

U.S. PATENT DOCUMENTS

| | | | |
|---|---|---|---|
| 3,091,091 | 5/1963 | Ferrante | 62/530 X |
| 3,309,890 | 3/1967 | Barnett et al. | 62/457 X |
| 3,636,726 | 1/1972 | Rosenfeld et al. | 62/294 |
| 3,852,975 | 12/1974 | Beck | 62/457 X |
| 4,054,037 | 10/1977 | Yoder | 62/530 X |
| 4,126,016 | 11/1978 | Greiner | 62/480 X |
| 4,250,720 | 2/1981 | Siegel | 62/480 |
| 4,462,224 | 7/1984 | Dunshee et al. | 62/4 X |
| 4,628,703 | 12/1986 | Kim | 62/294 |

*Primary Examiner*—Lloyd L. King

[57] ABSTRACT

The temperature changers consist of at least 2 communicating chambers. One chamber contains a partial air vacuum which lowers the boiling point of water present in the chamber. A second chamber contains a dessicant which adsorbs or absorbs the vapor generated by the boiling water in the water chamber. Inner support bodies between the walls of the chambers prevent the walls of the chambers from collapsing during the presence of the vacuum inside the chambers. Pores and channels inside the support body provide inter-communicating free spaces inside the chambers. In the present invention the heat exchange surfaces of the chambers are structurally adapted to be completely immersed in a beverage to increase the heat transfer actions of the surfaces. In a modified form of the invention multiple dessicant chambers with separate communications with the water chamber are used. A serial opening of the communications between the water chamber and the multiple dessicant chambers causes multiple vigorous boiling periods of the water, and lowers the final temperature of the beverage.

2 Claims, 3 Drawing Sheets

SELF COOLING AND SELF HEATING DISPOSABLE BEVERAGE CANS

BACKGROUND AND OBJECTIVES

The invention relates to self-cooling cans, and in particular to improvements in sorption temperture changers which were prevously patented by the present inventor. The sorption temperature changers have been described in detail in U.S. Pat. No. 4,250,720 (1981). Essentially, the sorption temperature changers use the fact that the boiling temperature of water is lowered under a partial vacuum. The basic components of the temperature changers are 2 chambers consisting of a water chamber and a dessicant chamber. The water chamber contains water under a vacuum. The water boils in the water chamber at relatively low temperatures because of the partial vacuum in the chamber. This cools the surfaces of the water chamber. The cold surfaces of the water chamber then absorb heat from a beverage.

The removal of the vapors generated by the boiling water is essential for the initiation and continuation of the boiling of the water in the water chamber. This vapor removal is accomplished by a dessicant in the dessicant chamber which adsorbs or absorbs the vapors generated by the boiling water in the water chamber. The boiling of the water in the water chamber is reglulated by opening and closing the communication between the cooling chamber and the dessicant chamber. When the communication between the water and dessicant chamber is closed the boiling of the water stops. The temperature changers are inactive and can be stored for indefinite periods at environmental temperatures without losing their temperature changing potential. The temperature changing action of the device will, however, be initiated by the opening of the communication between the water and the dessicant containers.

The above disposable temperature changers suffer from the fact that their chambers require relatively strong walls to withstand the outside atmospheric pressures during the initiation of the partial vacuum in the chambers. The strong walls may be too expensive for the disposable forms of the temperature changers. The present invention provides new means whereby a vacuum can be maintained in weak wall chambers. This is achieved through porous support bodies placed between the walls of the chambers. As will be described in detail, the inner body maintains the interspaces in the cooling container, and provides an inner support for the walls of the container.

In the original patent the water chamber was adapted to serve as a wall of a beverage container. Under those conditions, one wall of the water chamber served as the inner surface of a the double walled beverage container, while the opposite wall of the water chamber served as the outer wall of the double wall beverage container. Thus, only half the surfaces of water chamber (the inner wall of the double wall beverage container) are in contact with the beverage and are available for absorbing heat from the beverage. The present invention contains a structural modification whereby the complete water chamber is immersed in the beverage. Thus, all the potential heat exchange surfaces of the chambers become available for cooling the beverage.

In one version of the present invention multiple dessicant chambers are used instead of the single dessicant chamber used in the unmodified form of the invention. Each of the multiple dessicant chamber communicates independently with the water chamber. This is based upon the fact that the most rapid cooling occurs during the initial exposure of the dessicant to the water vapor. Thus, when the communication between the water and the dessicant chamber is first established there is a vigorous boiling of the water in the cooling chamber and a rapid heat loss from the beverage. This is followed by a slower rate of evaporation, and a slower cooling of the beverage. This occurs before the dessicant becomes saturated with the vapor and is independent of the temperature of the water. The multiple dessicant chambers provide means whereby the the more rapid initial boiling of the working fluid and cooling can be repeated without increasing the total quantity of the dessicant. This is accomplished by means which allow serial exposures of the water chamber to the dessicant chambers.

A more detailed description of the above improvements. given in the Detailed Description section, will further clarify the nature of the improvements.

SUMMARY

The invention consists of structural modifications in sorption temperature changers. The modifications result in the following improvements: (1) Low cost materials such as those used in standard beverage cans can be used. (2) The working heat exchange surfaces of the temperaure changers are increased. (3) The final temperature of the cooled beverage is lowered.

The basic components of both the original and the present improved versions of the sorption temperature changers are at least 2 communicating chambers consisting of a water chamber and a dessicant chamber. The water chamber contains water under a vacuum. The water boils in the cooling chamber at relatively low temperatures because the vacuum lowers the boiling point of the water. A dessicant in a separate chamber adsorbs or absorbs the vapors generated by the boiling water in the cooling chamber. The water chamber is cooled by the evaporating boiling water while the dessicant chamber is heated by the adsorbed or absorbed vapor. The sorption of the vapor by the dessicant is essential for the boiling of the water. The opening and closing of the communication between the water and the dessicant chamber can therefore be used to control the temperature changing actions of temperature changers. When the communication between the chambers is closed the device can be stored for indefinte periods without losing its temperature changing potential. The temperature changing action of the device is initiated by the opening of the communication between the water and the dessicant chamber.

The cold water chamber is used to absorb heat from a beverage and thus cool the beverage. The hot dessicant chamber is used to transfer heat to a beverage and thus heat a beverage. The above heat transfer processes are facilitated in the present invention by new structural modifications which allow the heat exchange surfaces of the chambers to be completely immersed in the beverage.

Other structural modifications include inner support bodies placed inside the chambers between the inner walls of the chambers. This prevents the collapse of the chamber walls by atmospheric pressures during the induction of a vacuum in the chambers. The supports bodies contain inter-communicating pores and channels to provide spaces for the working components in the chambers. Because of such inner supports the chambers can be built from relatively weak and low cost materials such as those used to build standard beverage cans.

The most vigorous boiling of the water usually occurs during the first 1–2 minutes after a communication between the water and a dessicant chamber has been established. The present invention extends this initial burst of activity in order to enhance the temperature changing action of the sorption temperature changers. This is accomplished by multiple dessicant chambers with separate communications with the water chamber. A serial opening of the communications between the water chamber and the dessicant chambers results in a serial repetition of the vigorous boiling of the water and the lowering of the final temperature of the beverage which is being cooled.

DETAILED DESCRIPTION

Figure 1:
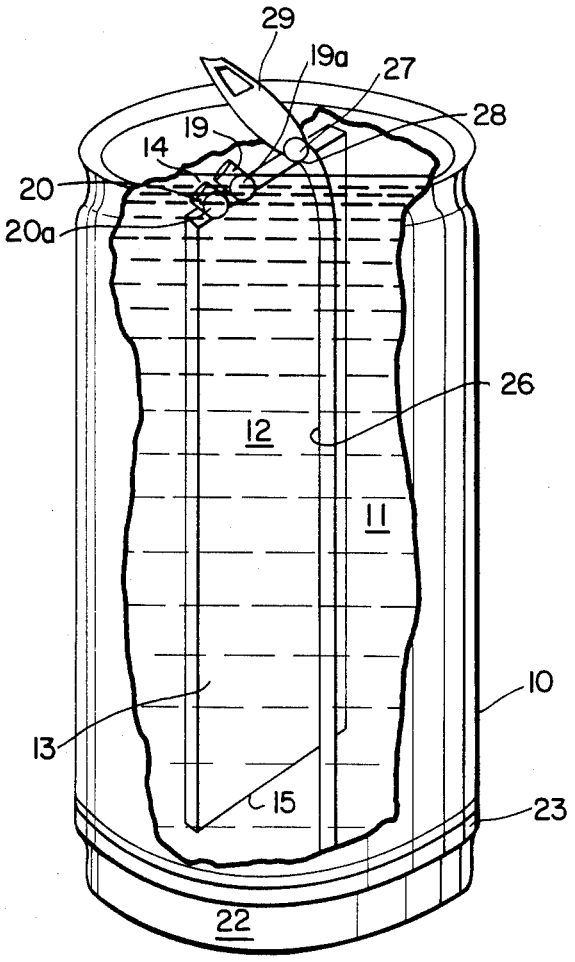
FIG. 1 is an open three dimensional view of an embodiment of a self cooling can.

A temperature changing can is illustrated in FIG. 1. As seen, there is present a can 10. The can 10 is made of standard can materials such as thin aluminum. The can contains a beverage 11 such as coke or beer. Tab 28 in the upper surface of can 10 opens and closes the can.

Figure 2:
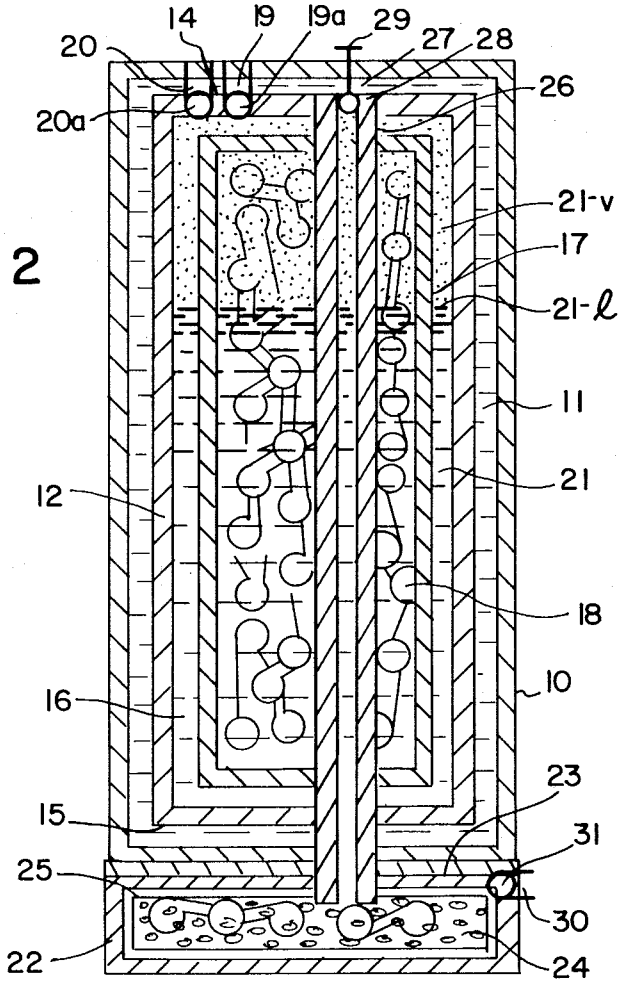
FIG. 2 is a cross sectional view of an embodiment of a self cooling can.

Present inside can 10 and immersed in bevrerage 11 is a sorption water chamber 12. The water chamber 12 is illustrated in FIGS. 1–2. As seen, the water chamber 12 is in a shape of a flat rectangle. The chamber 12 has side walls 13, upper wall 14, and lower wall 15. The walls 14 and 15 are relatively narrow so that container 12 is flat. The side walls 13 are relatively large and provide container 12 with a relatively large surface to volume ratio. The chamber 12 may be made from relatively weak thin aluminum such as the type of aluminum used to make standard beverage cans.

Present inside water chamber 12 is space 16. Present inside space 16 is a support body 17. The body 17 occupies most of space 16 so that it forms an inner support for walls 13–15 of chamber 12. The support body 17 may be made from any inert material such as aluminum or plastic. The body 17 contains interconnected pores and inner channels 18. The distribution of the pores and channels 18 is such that there is a free communication between the pore and channel spaces in the body. Present on top wall 14 of chamber 12 are outlet 19 and inlet 20. Valve **19*a* closes and opens outlet 19. Valve 20*a* closes and opens inlet 20. The arrangement is that air is evacuated from chamber 12 through outlet 19 when valve 19*a* is open. When a predetermined vacuum has been established the valve is moved to close outlet 19. Valve 20*a* is then opened and water 21 is introduced into container 12 through inlet 20. When the water enters container 12 it is distributed in the interspace between support body 17 and walls 13–15 in cotainer 12, and in the intercommunicating pore and channel in body 17. After a predetermined quantity of water has been transferred into container 12, the inlet 20 is closed. The water 21 is thus kept under a partial vacuum in chamber 12. The degree of the vacuum in chamber 12 is such that it lowers the boiling point of the water to a predetermined cold temperature. For example, a vacuum of 4.6 mm Hg can be induced in the water chamber. This lowers the boiling point of the water to about 0 degrees C. The liquid 21 evaporates to form a vapor phase 21-v in the upper portion of chamber 12, and a liquid phase 21-l in the lower portion of chamber 12. Upon the development of the proper vacuum in container 12 and the introduction of the water into container 12, the outlet 19 and the inlet 20** may be permenantly sealed (not shown).

Present below can 10 is a dessicant chamber 22. The chamber 22 is separated from the bottom wall of can 10 by an insulating layer 23. Inside chamber 22 there is a a dessicant 24 such as anhydrous calcium-sulfate, and a support body 25. The arrangment is such that the body 25 together with the dessicant salt 24 provide an inner support to the walls of the the dessicant chamber 22. A pipe 26 communicates between the top of chamber 22 and the vapor phase 21-v of water container 12. The communication of pipe 26 with water chamber 12 occurs through opening 27 present in the upper wall 14 of the water chamber 12. The opening 27 is controlled by valve 28. The valve 28 is attached to tab 29 which opens can 10. The arrangement is such that when tab 29 closes can 10 the valve 28 is in its closed position and prevents a communication between water container 12 and dessicant chamber 22. When tab 29 is pulled to open can 10 it also pulls valve 28 to its open position. Thus, a communication is established between the water container 12 and dessicant chamber 22. Present in the upper portion of chamber 22 is an outlet 30. A valve 31 opens and closes outlet 30. The arrangement is such that air is evacuated from the chamber 22 and pipe through outlet 30. The air evacuation takes place from outlet 30 when valve 31 is open. When the proper vacuum is established the valve 31 is closed to maintain the vacuum in the chamber The operation of the cooler is as follows: When a cooling effect is not desired, the valve 28 closes pipe 26 and prevents a communication between chamber 12 and dessicant chamber 22. The water 21 in chamber 12 boils until the vapor phase 21-v is saturated. This stops the boiling of water 21. The can could then be stored for indefinite periods at ambient temperature without losing its self cooling potential.

When a cooling effect is desired the tab 29 is pulled to open can 10. This moves valve 28 to its open position. A communication between water chamber 12 and dessicant chamber 22 is then established. When this occurs the vapor in vapor phase 21-v in chamber 12 leaves the chamber 12 and enters the dessicant chamber 22. When the vapor enters the chamber 22 it is adsorbed or absorbed by the dessicant 24 in the chamber. This causes more vapor to leave container 12 to enter dessicant chamber 22, and to be absorbed or adsorbed by dessicant 24. The removal of the water vapor from chamber 12 causes water to continue to boil in the chamber 12. The boiling water absorbs heat and cools the surfaces of chamber 12. The cold surfaces of water chamber 12 which are immersed in beverge 11, then remove heat from the beverage and cool the beverage. This cooling action continues until the dessicant is saturated with water vapor, or until the temperature of the beverage is diminished to the boiling temperature of the water.

Figure 3:
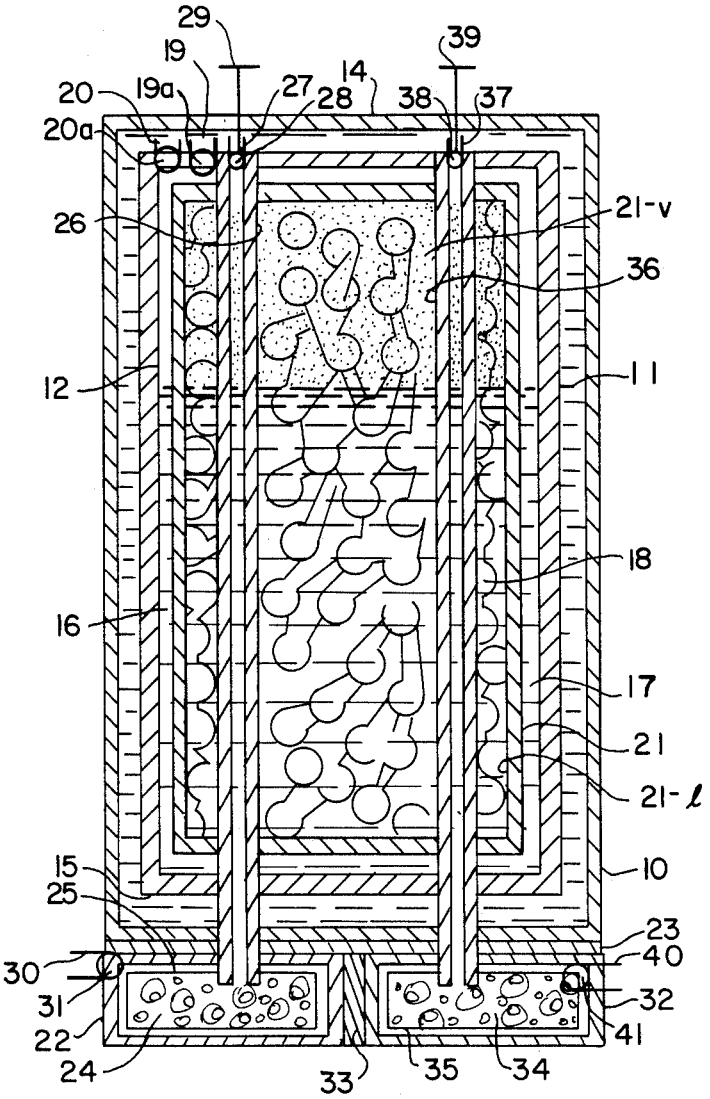
FIG. 3 is a cross sectional view of an embodiment of a self cooling can with multiple dessicant chambers.

FIG. 3 illustrates a modified self cooling can with 2 dessicant chambers with separate communications with the cooling chamber. It is similar to the can which has been illustrated in FIG. 1, except that it has been adapted to function with more than 1 dessicant chamber. The componenents 10–13 in FIG. 3 are identical to components of similar numbers in FIG. 2. As illustrated in FIG. 3, a second dessicant chamber 32 is present near dessicant chamber 22. An insulating layer 33 is present between the dessicant chambers 22 and 32. Present inside dessicant chamber 32 is a dessicant 34 and a support body 35. A pipe 36 forms a communication between dessicant chamber 32 and the vapor phase 21-v of chamber 12. The pipe 36 communicates with chamber 12 through outlet 37 in the upper wall 14 of chamber 12. Valve 38 opens and closes outlet 37. A tab 39 is attached to valve 38. The arrangement is that valve 38 is in its closed position during storage of the can 10. When the tab 39 is pulled it moves valve 39 to its open position. This establishes a communication between the vapors of container 12 and the dessicant chamber 32. Present in the upper portion of chamber 32 is an outlet 40. A valve 41 opens and closes the outlet. The arrangement is such that air is evacuated from chamber 32 through outlet 40. When the proper air vacuum is established the valve 41 is closed to maintain the vacuum in the chamber.

The operation of the self cooling can illustrated in FIG. 3 is as follows. During storage of the can (when a cooling effect is not desired) the valves 2B and 3B are in their closed positions, and there is no communication between the cooling chamber 12 and the dessicant chambers 22 and 32. When a cooling effect is desired the tab 29 is pulled to open can 10. This moves valve 28 to its open position. A communication between container 12 and the first dessicant chamber 22 is thus established. This results in a vigorous boiling of water 21 and a rapid loss of heat from chamber 12. When this occurs the vapor in vapor phase 21-v in container 12 leaves the container 12 and enters the dessicant chamber 22. When the vapor enters the chamber 22 it is adsorbed or absorbed by the dessicant 24 in the chamber. This causes more vapor to leave chamber 12 to enter dessicant chamber 22, and to be absorbed or adsorbed by dessicant 24. The removal of the water vapor from chamber 12 causes more water to boil in the chamber. The boiling water absorbs heat and cools the surfaces of chamber 12. The cold surfaces of chamber 12, which are immersed in beverage 11, then remove heat from the beverage, and thus cool the beverage. After a short pause of about 2 minutes (when the beverage has reached its lowest temperature), the tab 39 is pulled to open valve 38 and to establish a communication between cooling chamber 12 and the second dessicant chamber chamber 32. This results in the resumption of the vigorous boiling of the water 21 and additional rapid loss of heat from chamber 12. The chamber 12 then further reduces the temperature of the beverage 11.

Figure 4:
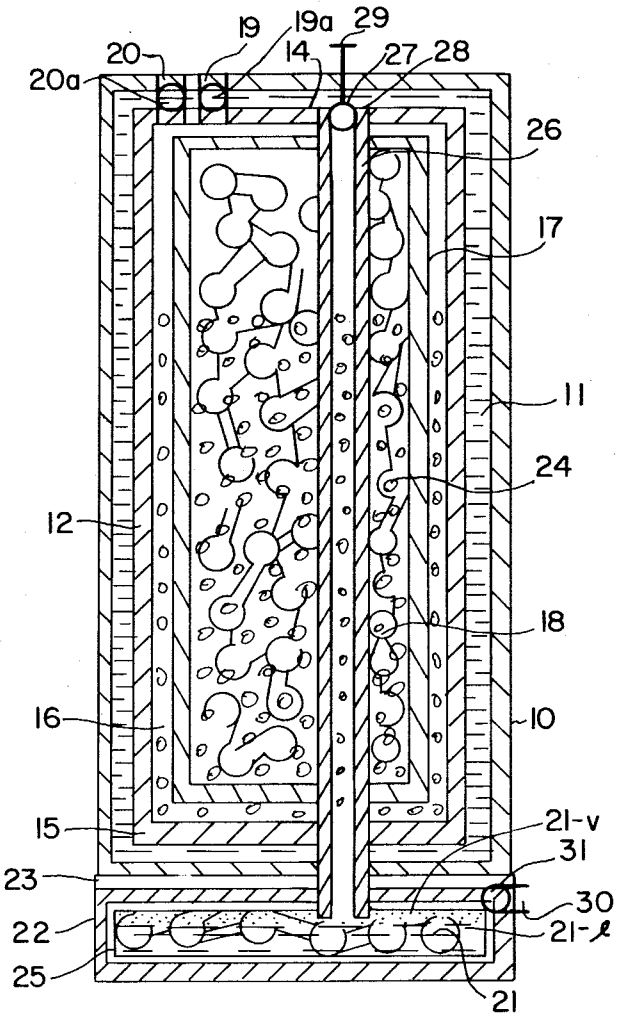
FIG. 4 is a cross sectional view of an embodiment of a self heating can.

While the invention illustrated in FIG. 4 shows a cooling can with 2 dessicant chambers, more dessicant chambers may be used to extend the periods of vigorous boiling of water 21 and the rapid heat loss from beverage 11. The self cooling can may likewise contain more than 1 cooling water chamber to increase the heat exchange surfaces in the beverage 11.

FIG. 4 is an illustration of a self heating can. As can be seen in the fig. the self heating can is made of the same basic components as the self cooling can which has been illustrated in FIG. 1. The only differences are the facts that in FIG. 4 the chamber 12 contains the dessicant 24, and the chamber 22 contains the water 21. The water 21 forms a liquid phase 21-l, and a vapor phase 21-v in the chamber 22.

The operation of the self heating can is as follows. When a heating effect is not desired, the valve 28 closes pipe 26 and prevents a communication beween dessicant chamber 12 and water chamber 22. The water 21 in chamber 22 boils until the vapor phase 21-v in the container 22 is saturated with water vapor. This stops the boiling of water 21. The can could then be stored for indefinite periods without losing its heating potential.

When a heating effect is desired the tab 29 is pulled to open can 10. This moves valve 28 to its open position. A communication between dessicant chamber 12 and water chamber 22 is then established. When this occurs the vapor in vapor phase 21-v in chamber 22 leaves the chamber 22 and enters the dessicant chamber 12. When the vapor enters the chamber 12 it is adsorbed or absorbed by the dessicant 24 in the chamber. As the vapor is removed by the dessicant 24, the heat of evaporation in the vapor is transferred to the dessicant. This raises the temperature of the dessicant. The removal of the water vapor from container 22 causes more water to boil in the water chamber 22 and to generate new vapor molecule. The vapor molecules enter the dessicant chamber 12 and continue to heat the dessicant 24 in the chamber. The hot dessicant heats the surfaces of the dessicant chamber 12. The hot surfaces of container 12, which are immersed in beverage 11, then transfer heat to the beverage 11 and heat the beverage.

It is understood that the self cooling or heating containers may consist not only of cans but of other types of containers such as bottles and boxes. The invention may be used not only to change the temperatures of beverages but of other items which could benefit from a temperature change. For example, the self heating invention may be used heat a beverage such as saki, or to heat a car battery during a cold winter day.

What is claimed is:

1. A temperature changing device consisting of at least one liquid chamber and one dessicant chamber, an inner support body in at least one of said chambers said support body containing inter-communicating spaces, said support bodies include support means to naintain said inter-communicating spaces during the presence of a vacuum in said chambers, a liquid in said liquid chamber, at least a partial air vacuum in said liquid chamber to lower the boiling point of said liquid, a dessicant in said dessicant chamber, said dessicant having an affinity for the vapors generated by said liquid, a communication between said liquid and said dessicant chambers to obtain a sorption of vapors generated by said liquid, and means to reversibly close said communication to obtain and unlimited storage of the temperature changing potential of said temperature changing device.

2. A temperature changing device consisting of at least one liquid chamber, a liquid in said liquid chamber, at least a partial air vacuum in said liquid chamber to lower the boiling point of said liquid, multiple dessicant chambers, a separate communication between each of said dessicant chambers with said liquid chamber, and means to reversibly close said communicantions to obtain an unlimited storage of the temperature changing potentials of said temperature changing device.

* * * * *